US010163552B2

(12) United States Patent
Huang et al.

(10) Patent No.: US 10,163,552 B2
(45) Date of Patent: Dec. 25, 2018

(54) ROTARY VARIABLE RESISTOR

(71) Applicant: TAIWAN ALPHA ELECTRONIC CO., LTD., Taoyuan (TW)

(72) Inventors: Tzu-Hsuan Huang, Taoyuan (TW); Wei-Liang Liu, Taoyuan (TW); Chien-Chih Ho, Taoyuan (TW)

(73) Assignee: TAIWAN ALPHA ELECTRONIC CO., LTD., Taoyuan (TW)

( * ) Notice: Subject to any disclaimer, the term of this patent is extended or adjusted under 35 U.S.C. 154(b) by 71 days.

(21) Appl. No.: 15/351,903

(22) Filed: Nov. 15, 2016

(65) Prior Publication Data

US 2017/0178770 A1 Jun. 22, 2017

(30) Foreign Application Priority Data

Dec. 18, 2015 (TW) ..... 104142680 A

(51) Int. Cl.

| | |
|---|---|
| ***H01C 10/34*** | (2006.01) |
| ***H01C 1/01*** | (2006.01) |
| ***H01C 10/00*** | (2006.01) |
| ***H01C 1/012*** | (2006.01) |

(52) U.S. Cl.

CPC ..... *H01C 10/34* (2013.01); *H01C 1/01* (2013.01); *H01C 1/012* (2013.01); *H01C 10/005* (2013.01)

(58) Field of Classification Search

CPC ..... H01C 10/34; H01C 10/005; H01C 1/01
USPC ..... 338/163; 200/293, 571
See application file for complete search history.

(56) References Cited

U.S. PATENT DOCUMENTS

| | | | | |
|---|---|---|---|---|
| 3,205,466 A * | 9/1965 | Youngbeck | ..... | H01C 10/32 338/163 |
| 4,223,294 A * | 9/1980 | Moffitt | ..... | H01C 10/18 338/122 |
| 4,816,801 A * | 3/1989 | Spiller | ..... | H01C 10/14 338/163 |
| 4,928,082 A * | 5/1990 | Yagi | ..... | B29C 45/14639 338/174 |

* cited by examiner

*Primary Examiner* — Kyung Lee
*Assistant Examiner* — Iman Malakooti
(74) *Attorney, Agent, or Firm* — Muncy, Geissler, Olds & Lowe, P.C.

(57) ABSTRACT

A rotary variable resistor includes a resistance circuit module, a fixation frame, a brush assembly and a rotor shaft. The resistance circuit module has a circuit board, an output circuit, three input circuits and a resistance ring. The output circuit includes a brush contact port having an annular brush contact area and an output port extending out from the brush contact port. Each input circuit has a resistor contact end and an input port. The three resistor contact ends are evenly annularly separated. The resistance ring co-axially and annularly spaced to the brush contact port contacts the resistor contact ends. The fixation frame is fixedly mounted on the resistance circuit module. The brush assembly rotatably restrained by the fixation frame bridges the annular brush contact area and the resistance ring. The rotor shaft for driving the brush assembly is connected with the brush assembly.

8 Claims, 5 Drawing Sheets

ROTARY VARIABLE RESISTOR

This application claims the benefit of Taiwan Patent Application Serial No. 104142680, filed Dec. 18, 2015, the subject matter of which is incorporated herein by reference.

BACKGROUND OF INVENTION

1. Field of the Invention

The invention relates to a variable resistor, and more particularly to a rotary variable resistor that includes three input circuits and a resistance ring.

2. Description of the Prior Art

Generally, applications of variable resistors to control electronic devices can be seen everywhere in daily life. For example, the variable resistor can be used to control volume of audio equipment. Theoretically, the variable resistor is a resistor having two opposing end terminals to be fixed at two predetermined points and a middle contact to slide between these two opposing end terminals. With the middle contact to change its position on the transistor, corresponding voltage divisions could occur at this variable resistor.

As described, conventional variable resistors can be structurally classified into two groups: sliding variable resistors and rotary variable resistors. In particular, the rotary variable resistors can be further classified into single-turn variable resistors and multi-turn variable resistors. The single-turn variable resistor is a C-shape resistor having two close end terminals and a middle contact to slide along the C-shape resistor for generating different voltage divisions. On the other hand, the multi-turn variable resistor is consisted of multiple C-shape resistors for generating various voltage divisions. In the art, though the multi-turn variable resistor can generate more voltage divisions than the single-turn variable resistor, yet the structuring of the multi-turn variable resistor complicates the manufacturing process, and thus the cost thereof is hard to be lowered anyhow. Nevertheless, no matter what the single-turn variable resistor or the multi-turn variable resistor is, the rotational angle of the resistor is limited to the structure of the C-shape resistor.

SUMMARY OF THE INVENTION

As described above, it is understood that the conventional rotary variable resistors are classified into the single-turn variable resistors and the multi-turn variable resistors. Also, though the single-turn variable resistor is simply structured, yet less voltage divisions can be generated. Contrarily, though the multi-turn variable resistor can generate more voltage divisions, yet the complicated structuring thereof would make difficult the production. However, both aforesaid types of the variable resistors do have limited rotational angles due to the structuring of the C-shape resistor. Accordingly, to resolve or compromise all the foregoing structuring and manufacturing disadvantages in the rotary variable resistors, it is the primary object of the present invention to provide a rotary variable resistor that can be easily produced without sacrificing the number of voltage divisions.

In the present invention, the rotary variable resistor includes a resistance circuit module, a fixation frame, a brush assembly and a rotor shaft. The resistance circuit module further includes a circuit board, an output circuit, three input circuits and a resistance ring. The circuit board has a circuit arrangement portion and a terminal arrangement portion extending from the circuit arrangement portion. The output circuit includes a brush contact port and an output port. The brush contact port located at the circuit arrangement portion has an annular brush contact area defined with a central axis. The output port is extended from the brush contact port to the terminal arrangement portion. Each of the three input circuits has a resistor contact end and an input port. The three resistor contact ends of the three corresponding input circuits are evenly annularly separated around the central axis. Each of the input ports of the corresponding input circuits is extended from the corresponding resistor contact end to the terminal arrangement portion. The resistance ring centered at the central axis is annularly spaced to the brush contact port and contacts each of the resistor contact ends of the corresponding input circuits. The fixation frame is fixedly mounted on the resistance circuit module. The brush assembly is rotatably restrained by the fixation frame, and bridges the annular brush contact area and the resistance ring. The rotor shaft connected with the brush assembly is to drive the brush assembly.

In one embodiment of the present invention, the resistance circuit module further includes four transmission terminals electrically coupled individually with the output port and the three input ports of the corresponding input circuits. Preferably, the resistance circuit module further includes an insulation base, the circuit board being embedded in the insulation base, the four transmission terminals protruding out of the insulation base.

In one embodiment of the present invention, the brush assembly includes a rotary member and a brush member. The rotary member is located rotatably in the fixation frame. The brush member mounted fixedly on the rotary member further has an inner brush and an outer brush. Preferably, the rotary member further has a position slot for engaging removably the rotor shaft. In addition, the brush assembly the brush assembly further includes a clip for buckling the rotor shaft onto the brush assembly.

In one embodiment of the present invention, the rotary variable resistor further includes a shaft sleeve mounted on the fixation frame, the rotor shaft and allowing the shaft sleeve to penetrate therethrough.

In one embodiment of the present invention, the resistance circuit module further includes an insulation layer located between the output circuit and the resistance ring.

By compared to the conventional rotary variable resistor that needs a multi-turn resistor to generate multiple voltage divisions, the instant application can use a resistance ring, three input circuits and an output circuit to produce a circuit module without limitations upon the rotational angles. In addition, no matter what the angle is, at least two voltage divisions can be generated. Further, the user can precisely determine the accurate position of the brush assembly by evaluating the two corresponding voltage divisions.

All these objects are achieved by the rotary variable resistor described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a rotary variable resistor. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
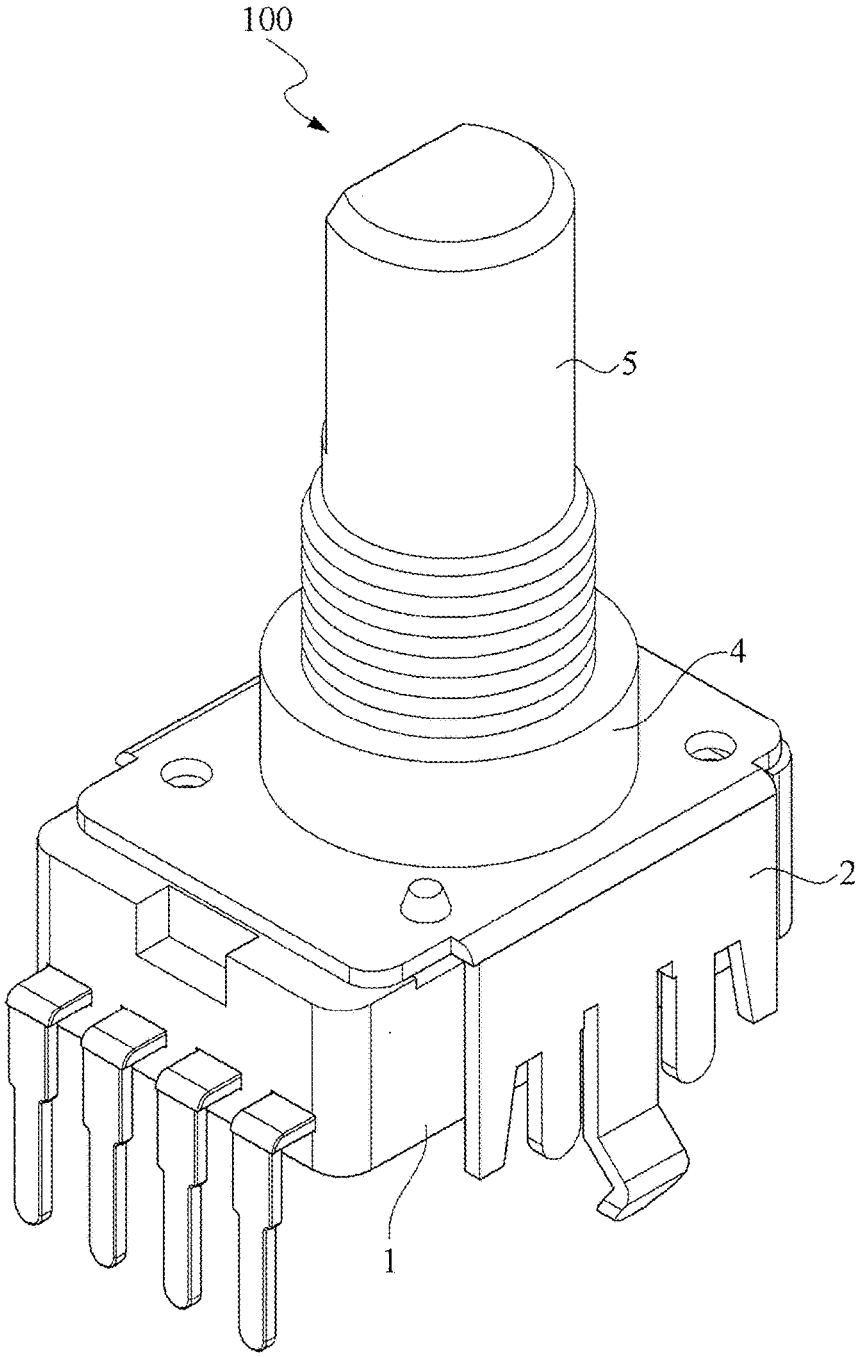
FIG. 1 is a schematic perspective view of a preferred embodiment of the rotary variable resistor in accordance with the present invention.
Figure 2:
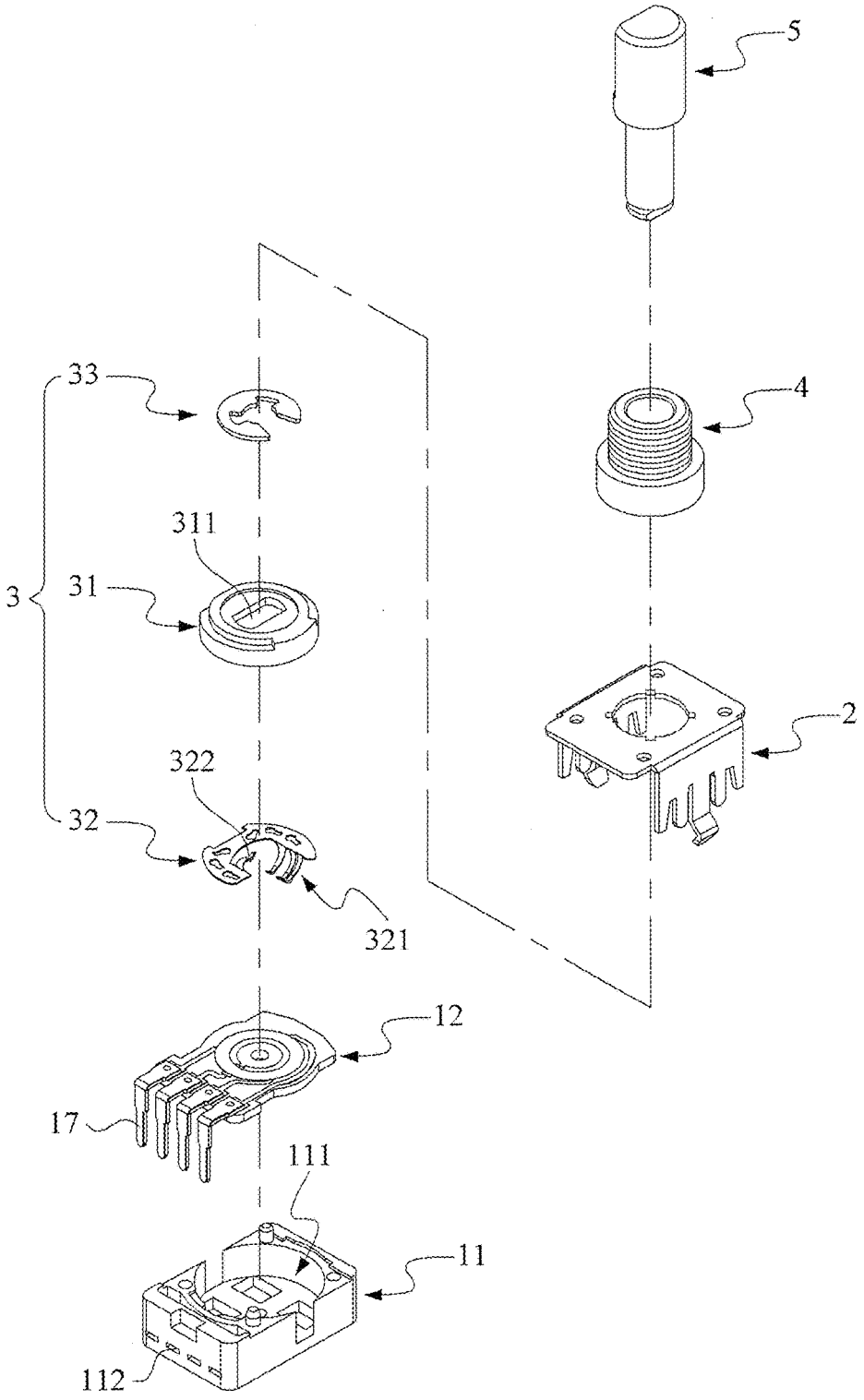
FIG. 2 is a schematic exploded view of FIG. 1.
Figure 3:
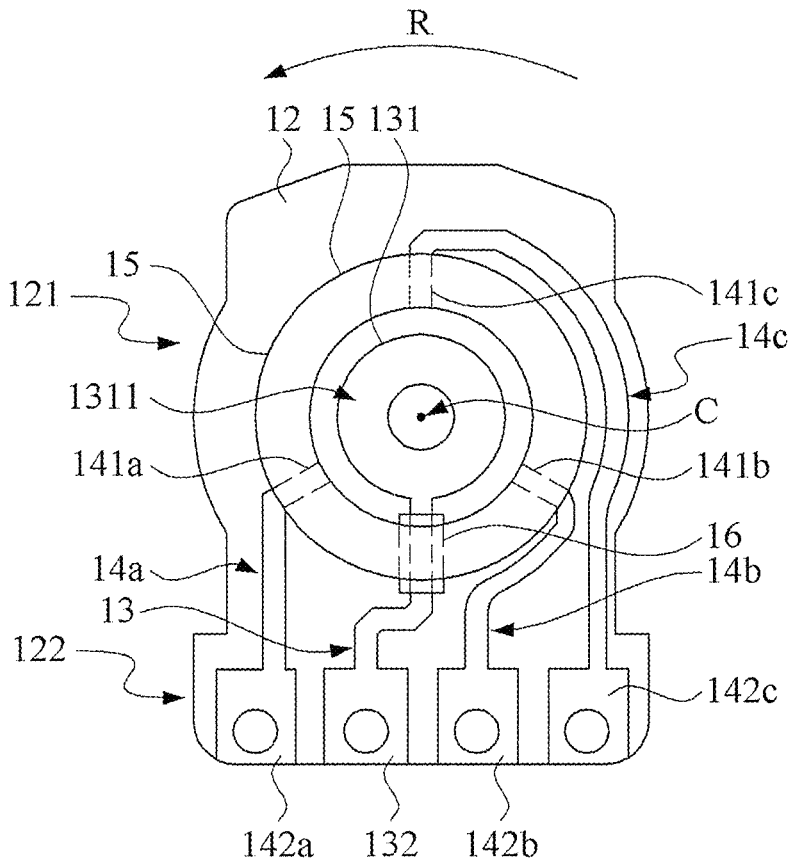
FIG. 3 is a schematic top view of the resistance circuit module of FIG. 2.

Refer now to FIG. 1 through FIG. 3; where FIG. 1 is a schematic perspective view of a preferred embodiment of the rotary variable resistor in accordance with the present invention, FIG. 2 is a schematic exploded view of FIG. 1, and FIG. 3 is a schematic top view of the resistance circuit module of FIG. 2.

As shown, the rotary variable resistor 100 includes a resistance circuit module 1, a fixation frame 2, a brush assembly 3, a shaft sleeve 4 and a rotor shaft 5.

The resistance circuit module 1 includes an insulation base 11, a circuit board 12, an output circuit 13, three input circuits 14*a*, 14*b*, 14*c*, a resistance ring 15, an insulation layer 16 and four transmission terminals 17 (one labeled in the figure).

The insulation base 11 has a middle accommodation room 111 and four perforations 112 (one labeled in the figure). As shown, these four perforations 112 are individually communicative in space with the accommodation room 111.

The circuit board 12 embedded inside the accommodation room 111 has a circuit arrangement portion 121 and a terminal arrangement portion 122 extended from the circuit arrangement portion 121.

The output circuit 13 includes a brush contact port 131 and an output port 132. The brush contact port 131 located at the circuit arrangement portion 121 has an annular brush contact area 1311 defined with a central axis C, and the output port 132 is extended from the brush contact port 131 to the terminal arrangement portion 122.

The input circuit 14*a* has a resistor contact end 141*a* and an input port 142*a*. The resistor contact end 141*a* is located at the circuit arrangement portion 121, and the input port 142*a* is extended from the resistor contact end 141*a* to the terminal arrangement portion 122.

The input circuit 14*b* has a resistor contact end 141*b* and an input port 142*b*. The resistor contact end 141*b* is located at the circuit arrangement portion 121, and the input port 142*b* is extended from the resistor contact end 141*b* to the terminal arrangement portion 122. In addition the angle of extension lines of the resistor contact end 141*a* and the resistor contact end 141*b* at the central axis C is 120 degrees.

The input circuit 14*c* has a resistor contact end 141*c* and an input port 142*c*. The resistor contact end 141*c* is located at the circuit arrangement portion 121, and the input port 142*c* is extended from the resistor contact end 141*c* to the terminal arrangement portion 122. In addition, the angle of extension lines of the resistor contact end 141*a* and the resistor contact end 141*c* at the central axis C is 120 degrees. Also, the angle of extension lines of the resistor contact end 141*c* and the resistor contact end 141*c* at the central axis C is 120 degrees as well. Namely, these three individual resistor contact ends 141*a*, 141*b* and 141*c* of the corresponding input circuits 14*a*, 14*b* and 14*c* are evenly annularly separated around the central axis C.

The resistance ring 15 centered at the central axis C is annularly spaced to the brush contact port 131 at the circuit arrangement portion 121, and contacts each of the resistor contact ends 141*a*, 141*b* and 141*c* by direct covering.

The insulation layer 16 is located between the output circuit 13 and the resistance ring 15.

The four transmission terminals 17 are to penetrate individually the corresponding perforations 112, and are electrically coupled individually with the input ports 142*a*, 142*b*, 142*c* and the output port 132.

The fixation frame 2 is fixedly mounted on the insulation base 11 of the resistance circuit module 1.

The brush assembly 3 includes a rotary member 31, a brush member 32 and a clip 33. The rotary member 31 restrained by the fixation frame 2 is also rotatably with respect to the fixation frame 2. In addition, the rotary member 31 is constructed with a middle position slot 311. The brush member 32 mounted on the rotary member 31 by facing the circuit board 12 has an outer brush 321 and an inner brush 322. The outer brush 321 elastically contacts the resistance ring 15, and the inner brush 322 integrated with the outer brush 321 as a single piece elastically contacts the brush contact port 131, such that the annular brush contact area 1311 can be bridged to the resistance ring 15 via the brush member 32. The clip 33 is located and also restrained on the rotary member 31. In addition, in this preferred embodiment, the outer brush 321 is structured by two parallel elastic metal claws for contacting the resistance ring 15, and the inner brush 322 is structured by two opposing and symmetric elastic metal claws for contacting the brush contact port 131. In this embodiment, the brush member 32 is made from a copper plate. In some other embodiments of the present invention, the brush member 32 can be made from a conductive metal plate.

The shaft sleeve 4 is mounted on the fixation frame 2. The rotor shaft 5 penetrating the shaft sleeve 4 is removably engaged at the position slot 311 of the rotary member 31. The clip 33 is used to buckle the rotor shaft 5 at the end thereof that is planted into the position slot 311, such that the rotor shaft 5 can be moved with the brush assembly 3.

Figure 4:
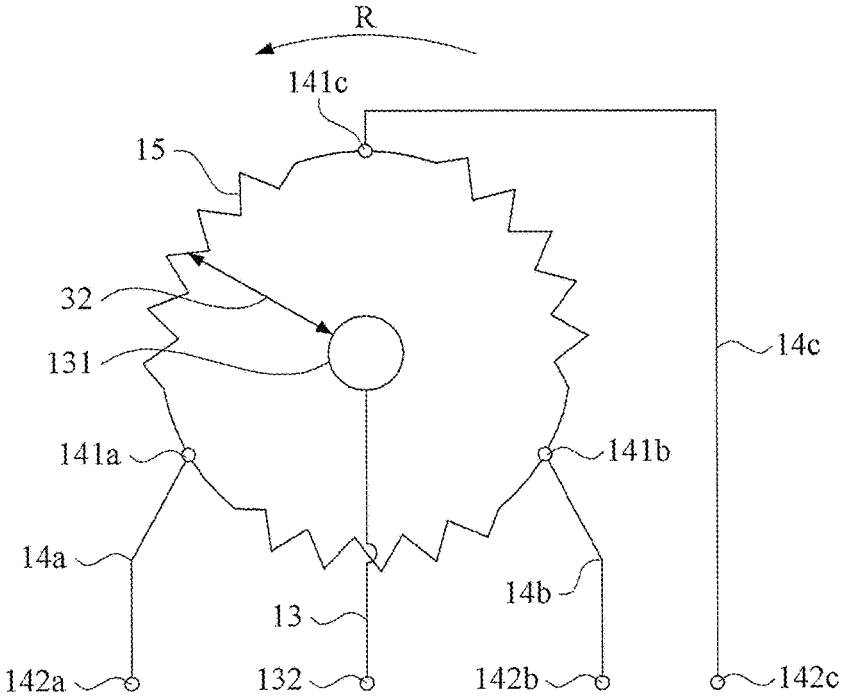
FIG. 4 is a schematic view of a circuit arrangement for the resistance circuit module of FIG. 3.
Figure 5:
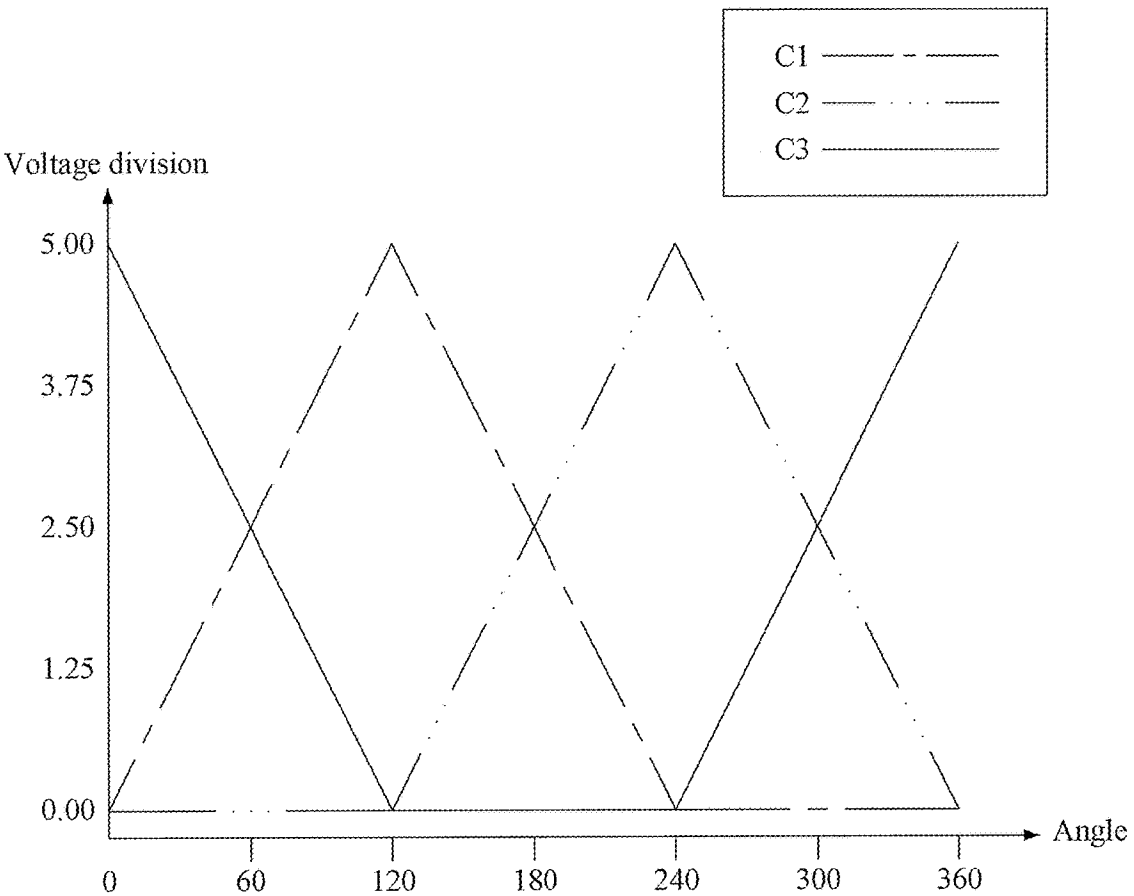
FIG. 5 is a plot showing the relationship between the rotational angles and of the rotor shaft and the voltage divisions outputted by the resistance circuit module of the rotary variable resistor in accordance with the present invention.

Refer now to FIG. 4 and FIG. 5; where FIG. 4 is a schematic view of a circuit arrangement for the resistance circuit module of FIG. 3, and FIG. 5 is a plot showing the relationship between the rotational angles and of the rotor shaft and the voltage divisions outputted by the resistance circuit module of the rotary variable resistor in accordance with the present invention. As shown, by having the resistor contact end 141*a* as the basic start point, when the brush assembly 3 is rotated by the rotor shaft 5 to move from the resistor contact end 141*a* to the resistor contact end 141*b* along a direction of rotation R (i.e. 120° counter clockwise), the voltage division outputted from the input port 142*a* would vary gradually from 0V to 5V, i.e. curve C1 from 0° to 120°. At the same period, the voltage division outputted from the input port 142*b* would vary gradually from 5V to 0V, i.e. curve C3 from 0° to 120°. In addition, at the same period, the voltage division outputted from the input port 142*c* would maintain at 0V, i.e. no voltage division output.

When the brush assembly 3 is rotated by the rotor shaft 5 to move from the resistor contact end 141*b* to the resistor contact end 141*c* along the direction of rotation R (i.e. another 120° counter clockwise), the voltage division outputted from the input port 142*a* would maintain at 0V, i.e. no voltage division output. At the same period, the voltage division outputted from the input port 142*b* would vary gradually from 0V to 5V, i.e. curve C2 from 120° to 240°. In addition, at the same period, the voltage division outputted from the input port 142*c* would vary gradually from 5V to 0V, i.e. curve C1 from 120° to 240°.

When the brush assembly 3 is rotated by the rotor shaft 5 to move from the resistor contact end 141*c* back to the resistor contact end 141*a* along the direction of rotation R (i.e. a further 120° counter clockwise), the voltage division outputted from the input port 142*a* would vary gradually from 5V to 0V, i.e. curve C2 from 240° to 360°.

At the same period, the voltage division outputted from the input port 142*b* would maintain at 0V, i.e. no voltage division output. In addition, at the same period, the voltage division outputted from the input port 142*c* would vary gradually from 0V to 5V, i.e. curve C3 from 240° to 360°.

In FIG. 5, it shall be noted that the 0.00-V baseline is drawn above Degree-axis, so that all the 0-V segments (i.e. no voltage division output) can be easily observed. All these 0-V segments include C2 0°, 120°, C3 120°, 240° and C1 240°, 360°.

As described above, in practice, the output port 132, the input port 142*a*, the input port 142*b* and the input port 142*c* are all connected to a controller (not shown in the figure), so that the controller can define individually the input port 142*a*, the input port 142*b* and the input port 142*c* as the voltage divisions for testing the output port 132 at a high potential. Based on the measured voltage divisions, the position of the brush assembly 3 can be determined. In practice, the controller can set firstly the input port 142*a* and the input port 142*c* to be high potential and the input port 142*b* to be low potential, and thus a first voltage division V1 can be detected at the output port 132. Then, the controller sets the input port 142*b* and the input port 142*c* to be high potential and the input port 142*a* to be low potential, thus a second voltage division V2 can be detected at the output port 132. Further, the controller sets the input port 142*a* and the input port 142*b* to be high potential and the input port 142*c* to be low potential, thus a third voltage division V3 can be detected at the output port 132. When all the first voltage division V1, the second voltage division V2 and the third voltage division V3 are obtained by the aforesaid setting and detection, then an analysis upon the first voltage division V1, the second voltage division V2 and the third voltage division V3 can be performed. In the case that the first voltage division V1≤the second voltage division V2, and the first voltage division V1≤the third voltage division V3, then it can be judged that the brush assembly 3 is positioned between the resistor contact end 141*a* and the resistor contact end 141*c*. in the case that the first voltage division V1≤the second voltage division V2, and the third voltage division V3≤the first voltage division V1, then it can be judged that the brush assembly 3 is positioned between the resistor contact end 141*a* and the resistor contact end 141*b*. Further, in the case that the second voltage division V2≤the first voltage division V1, and the second voltage division V2<the third voltage division V3, it can be judged that the brush assembly 3 is positioned between the resistor contact end 141*b* and the resistor contact end 141*c*. Otherwise, in the case that the second voltage division V2≤the first voltage division V1, and the third voltage division V3<the second voltage division V2, then it can be judged that the brush assembly 3 is positioned between the resistor contact end 141*a* and the resistor contact end 141*b*.

As described above, by compared to the conventional rotary variable resistor that needs a multi-turn resistor to generate multiple voltage divisions, the instant application can use a resistance ring, three input circuits and an output circuit to produce a circuit module without limitations upon the rotational angles. In addition, no matter what the angle is, at least two voltage divisions can be generated. Further, the user can precisely determine the accurate position of the brush assembly by evaluating the two corresponding voltage divisions.

While the present invention has been particularly shown and described with reference to a preferred embodiment, it will be understood by those skilled in the art that various changes in form and detail may be without departing from the spirit and scope of the present invention.

What is claimed is:

1. A rotary variable resistor, comprising:

a resistance circuit module, including:

a circuit board, having a circuit arrangement portion and a terminal arrangement portion extending from the circuit arrangement portion;

an output circuit, including:

a brush contact port, located at the circuit arrangement portion, having an annular brush contact area defined by a central axis; and an output port, extending from the brush contact port to the terminal arrangement portion;

three input circuits, each of the input circuits having a resistor contact end and an input port, corresponding resistor contact ends of the three input circuits being evenly annularly separated around the central axis, each of the input ports of the corresponding input circuits being extended from the corresponding resistor contact end to the terminal arrangement portion; and a resistance ring, centered at the central axis, annularly spaced to the brush contact port, contacting each of the resistor contact ends of the corresponding input circuits;

a fixation frame, fixedly mounted on the resistance circuit module;

a brush assembly, rotatably restrained by the fixation frame, bridging the annular brush contact area and the resistance ring; and a rotor shaft, connected with the brush assembly so as to drive the brush assembly.

2. The rotary variable resistor of claim 1, wherein the resistance circuit module further includes four transmission terminals electrically coupled individually with the output port and the three input ports of the corresponding input circuits.

3. The rotary variable resistor of claim 2, wherein the resistance circuit module further includes an insulation base, the circuit board being embedded in the insulation base, the four transmission terminals protruding out of the insulation base.

4. The rotary variable resistor of claim 1, wherein the brush assembly includes:

a rotary member, located rotatably in the fixation frame; and a brush member, mounted fixedly on the rotary member, having an inner brush and an outer brush.

5. The rotary variable resistor of claim 4, wherein the rotary member further has a position slot for engaging removably the rotor shaft.

6. The rotary variable resistor of claim 5, wherein the brush assembly further includes a clip for buckling the rotor shaft onto the brush assembly.

7. The rotary variable resistor of claim 1, further including a shaft sleeve mounted on the fixation frame, and allowing the rotor shaft to penetrate therethrough.

8. The rotary variable resistor of claim 1, wherein the resistance circuit module further includes an insulation layer located between the output circuit and the resistance ring.

* * * * *